United States Patent [19]

Smith

[11] 4,315,121

[45] Feb. 9, 1982

[54] SATURABLE MAGNETIC STEEL ENCASED COIL FOR ARC SPINNER INTERRUPTER

[75] Inventor: Robert K. Smith, Lansdale, Pa.

[73] Assignee: Gould Inc., Rolling Meadows, Ill.

[21] Appl. No.: 38,107

[22] Filed: May 11, 1979

[51] Int. Cl.[3] ..... H01H 33/18

[52] U.S. Cl. ..... 200/147 R

[58] Field of Search ..... 200/147 R

[56] References Cited

U.S. PATENT DOCUMENTS

| | | | |
|---|---|---|---|
| 2,112,033 | 3/1938 | Lingal et al. | 200/147 R |
| 4,206,330 | 6/1980 | McConnell et al. | 200/147 R |

FOREIGN PATENT DOCUMENTS

| | | |
|---|---|---|
| 695475 | 8/1940 | Fed. Rep. of Germany . |
| 893824 | 10/1953 | Fed. Rep. of Germany . |
| 2511238 | 9/1975 | Fed. Rep. of Germany . |
| 2285700 | 4/1976 | France . |
| 2414786 | 8/1979 | France . |
| 322966 | 12/1929 | United Kingdom . |

*Primary Examiner*—Robert S. Macon

*Attorney, Agent, or Firm*—Ostrolenk, Faber, Gerb & Soffen

[57] ABSTRACT

An arc spinner type interrupter has a stationary coil coupled magnetically to a disk-shaped arc runner. A magnetic core encases the coil and has an annular gap extending across the upper exposed surface of the arc runner to permit access of an arc root to the arc runner. The magnetic core material has high permeability at currents lower than the rated interrupting current of the device and the magnetic material saturates at higher current levels. The effect of the relatively high permeability saturable magnetic core is to increase the transient recovery voltage recovery characteristics of the interrupter at low currents without having to increase the number of turns of the coil. The electrical coil may be made of a spirally wound, relatively thin sheet of highly conductive material, or can be made of a square conductor wound in a coil form. The axial length of the coil is increased beyond that of prior art coils without substantially increasing the reluctance of the magnetic circuit. The electrical path from the coil to the arc runner includes parts of the magnetic circuit.

8 Claims, 12 Drawing Figures

FIG. 10
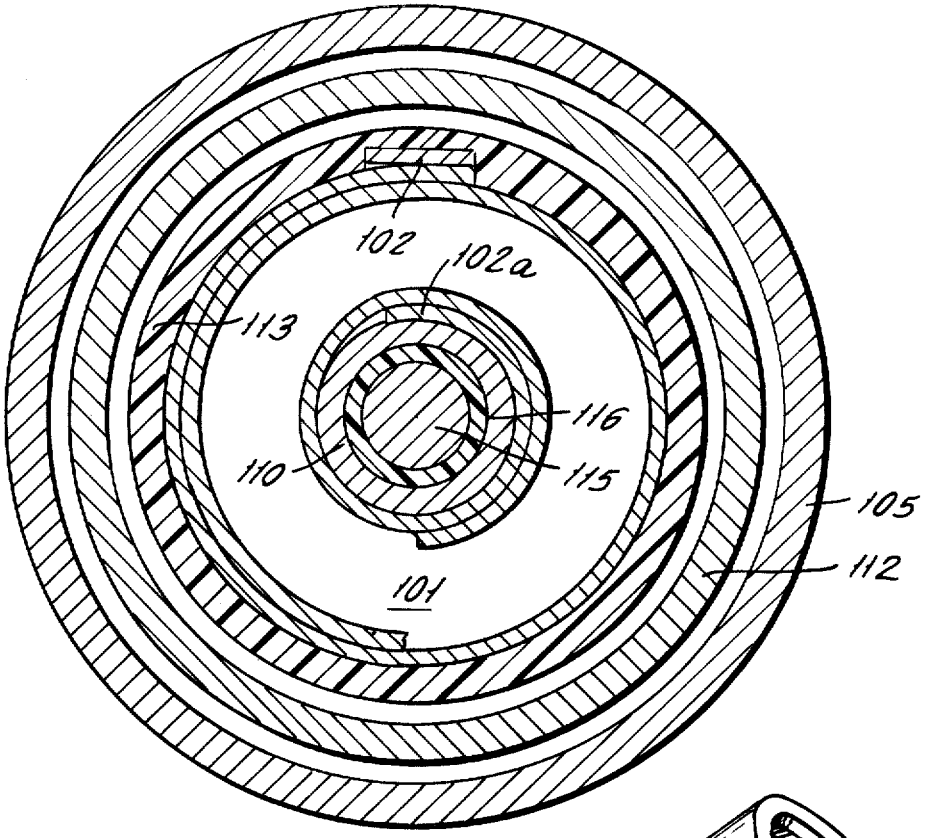
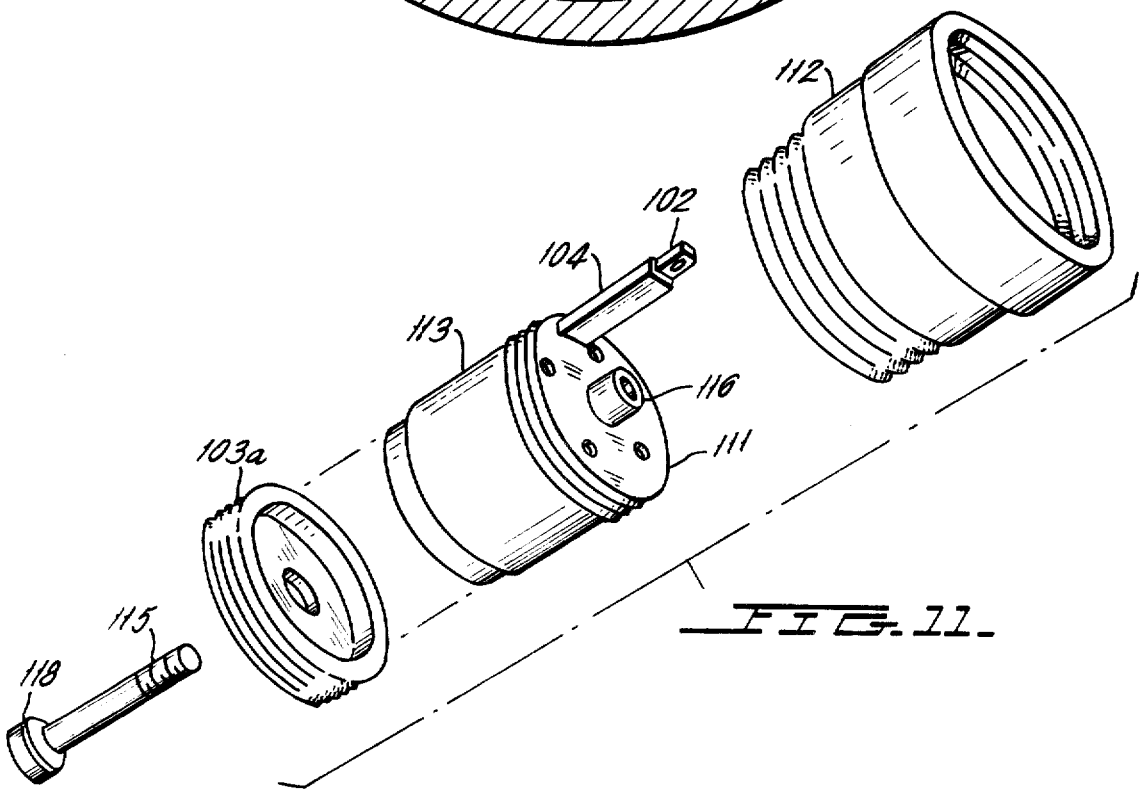
FIG. 11

SATURABLE MAGNETIC STEEL ENCASED COIL FOR ARC SPINNER INTERRUPTER

RELATED APPLICATIONS

This application is related to the following copending applications: Ser. No. 868,623, filed Jan. 11, 1978, in the names of Robert Kirkland Smith and Gerald A. Votta, and entitled THIN ARC RUNNER FOR ARC SPINNER INTERRUPTER; Ser. No. 868,622, filed Jan. 11, 1978, in the name of Robert Kirkland Smith, entitled EXTERIOR CONNECTED ARC RUNNER FOR ARC SPINNER INTERRUPTER; and Ser. No. 868,621, filed Jan. 11, 1978, in the names of Ruben D. Garzon, Lorne D. McConnell and Gerald A. Votta, entitled MOVING CONTACT FOR LOCALIZED GAS FLOW ARC SPINNER TYPE INTERRUPTER; and Ser. No. 868,624, filed Jan. 11, 1978, in the names of Lorne D. McConnell, Gerald A. Votta and Donald E. Weston entitled MOVING CONTACT FOR RADIAL BLOW-IN EFFECT FOR ARC SPINNER INTERRUPTER, all of which are assigned to the assignee of the present invention.

BACKGROUND OF THE INVENTION

This invention relates to arc spinner type circuit interrupters and more specifically relates to a novel improved arc spinner interrupter in which the coil of the arc spinner which induces a circulating current in the arc runner of the interrupter is enclosed by a relatively high permeability magnetic material which is saturable at relatively high coil current. The interrupter then exhibits improved interrupting characteristics at short-circuit currents which are relatively low compared to the rated short-circuit capabilty of the device without substantially increasing mechanical stresses within the assembly due to repulsion forces between the coil and the short-circuited arc runner at rated short-circuit current.

Arc spinner type interrupters are well known and typical prior art devices are disclosed in U.S. Pat. No. 4,052,577 in the name of Gerald A. Votta and U.S. Pat. No. 4,052,576 in the name of Robert Kirkland Smith.

In the arc spinner type interrupter, an arc is drawn between a circular arc runner and a relatively movable contact which moves into and out of engagement with the arc runner. The arc runner and movable contact are contained in a dielectric gas-filled housing. The gas may be sulfur hexafluoride or any other desired dielectric gas. The disk-shaped arc runner is closely magnetically coupled to a series-connected coaxial coil which carries the arc current and which also induces a circulating current in the arc runner which is formed in the manner of a short-circuited turn. The magnetic field produced by the circulating current in the arc runner and by the coil interact with the arc current in the arcing space between the contacts to create a Lorentz force which tends to rotate or spin the arc around the arc runner and relative to the dielectric gas which fills the arc space. The relative motion between the arc and the gas then causes the cooling and deionization of the arc to allow extinction of the arc when the arc current passes through zero.

All prior designs of the coil of an arc spinner interrupter use basically non-magnetic materials. Consequently, the force on the arc which tends to rotate the arc in the gas filling the arc space near arc current zero is a function of the RMS value of the current being interrupted.

Arc spinner interrupters using a coil composed of non-magnetic material have the ability to withstand a rapidly rising transient recovery voltage (TRV). This ability increases as the short-circuit current magnitude increases. However, as will be later described more fully, the TRV recovery rate required by ANSI standards is higher at low current that at high current. Consequently, a particular coil design which will meet the TRV requirements at high currents normally cannot interrupt the required TRV at low currents. This is because of the linear relationship between magnetic flux density and short-circuit current possessed by a coil composed of non-magnetic material.

The interrupting performance of the arc spinner interrupter can be improved by adding additional turns to the coil so that at low current a high enough magnetic flux will appear in the arc current space to produce the desired current interruption. Thus magnetic flux density is directly related to the number of turns used in the coil, and increasing the flux density will also increase the interrupting ability of the device. However, increasing the number of turns of the coil will increase the repulsion forces between the coil windings and the short circuited circular arc runner as the square of the current and the square of the number of coil turns. Thus increasing the number of turns of the coil to meet low current interrupting goals results in greatly increased repulsion forces at high currents. These forces can be large enough at high currents to deform the metal parts or break them and destroy the coil.

Consequently, the designer is faced by the dilemma that additional coil turns are required to meet low current interrupting goals, but fewer coil turns are required to keep repulsion forces between the coil and the arc runner within reasonable structural strength limits.

BRIEF DESCRIPTION OF THE PRESENT INVENTION

In accordance with the present invention, the coil of an arc spinner type interrupter is encased in a relatively high permeability material such as magnetic steel or the like which encloses substantially all of the coil except for the exposed annular surface of the arc runner to which the arc root of the arc current being interrupted is attached. Obviously, other small gaps in the magnetic structure can be provided as desired without departing from the scope of the invention.

The core of relatively high permeability material around the coil increases the flux density in the arc gap region adjacent the arc runner per ampere of coil current. Consequently, at low coil currents, a relatively high flux density will appear in the gap through which the arc will pass as compared to a coil design using non-magnetic parts. As a result, the interruption performance of the arc spinner interrupter is substantially improved at low currents. The magnetic material casing is arranged to saturate at higher coil currents where the interrupting ability of the interrupter is satisfactory in the absence of a high permeability enclosure for the coil. Thus a reasonably sized magnetic core can be used since it can saturate at the higher currents encountered by the interrupter structure.

By using the magnetic material casing for the coil, the necessary high flux density can be produced in the arc gap without having to increase the number of turns of the coil for low current operation. Therefore, the forces of repulsion between the coil and the arc runner at high current are no greater than in a prior art design using the same number of turns in a non-magnetic material environment. Thus, mechanical strength requirements of the design are not increased.

As a further feature of the invention, the novel magnetic enclosure can be formed of steel which can in turn be used as a part of the support structure for the coil, thus lending high strength and relatively low cost to the coil assembly. In addition, the steel path can form the current carrying path from the coil to the arc runner.

As a further feature of the invention, the use of the magnetic material substantially reduces the reluctance of the magnetic circuit regardless of the axial length of the coil. That is, the major part of the reluctance of the magnetic circuit will exist in the short gap in the magnetic casing which extends across the exposed upper surface of the arc runner disk. Consequently, some freedom is gained in the dimensions of the conductor ribbon used to form the spiral coil winding. In prior art designs there are design constraints on the width of the conductor since each turn of the coil is as closely coupled as possible to the arc runner. By using the novel magnetic casing for the coil, the individual conductors can be relatively thin and very wide and wound in a spiral form. The flux of each turn is carried to the gap at low current by the unsaturated magnetic casing. The increased length of the winding is compensated for by the magnetic material which allows a smaller winding diameter to be achieved with the thinner conductor ribbon.

BRIEF DESCRIPTION OF THE DRAWINGS

FIG. 10 is a cross-sectional view of FIG. 9 taken across section line 10—10 in FIG. 9.

FIG. 11 is an exploded perspective of the coil portion of FIGS. 9 and 10.

DETAILED DESCRIPTION OF THE DRAWINGS

Figure 1:
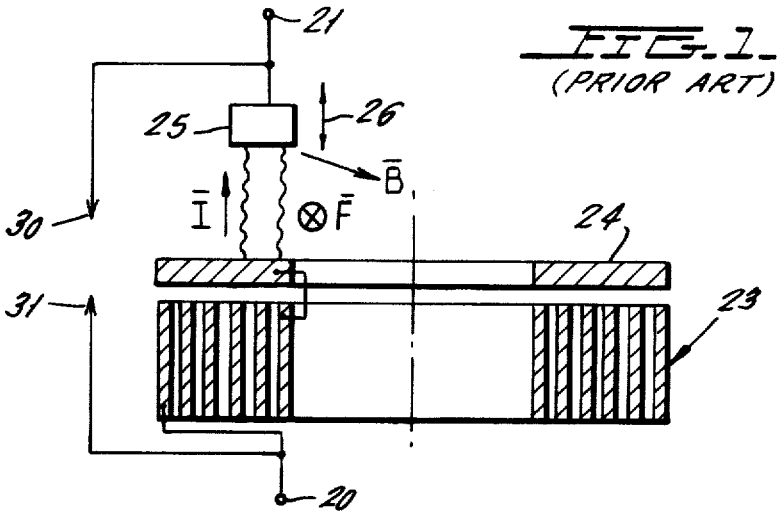
FIG. 1 (PRIOR ART)
FIG. 1 schematically illustrates the structure of a prior art type of arc spinner interrupter composed of non-magnetic material.

FIG. 1 schematically illustrates a typical prior art type arc spinner interrupter where the interrupter is inserted in a circuit between terminals 20 and 21. Terminal 20 is connected to multi-turn coil 23. Coil 23 is a spiral wound coil of relatively thin and relatively wide conductive material such as copper which is suitably fixedly supported in any desired manner, with the coil turns insulated from one another. The outside convolution of coil 23 is connected to termnal 20 and the inside of the coil is electrically connected to a stationary arc runner 24 which is a thin disk of conductive material such as chromium copper.

A movable contact schematically illustrated as movable arcing contact 25 is movable in the directions of double-headed arrow 26 into and out of engagement with arc runner 24 and is connected to the other terminal 21.

A pair of main contacts 30 and 31 are also provided and are connected to the movable arcing contact 25 and the bottom of coil 23 respectively as illustrated. Contact 31 can be a stationary contact.

During the operation of the interrupter, the main contacts 30 and 31 are opened before contact 25 is moved away from the arc runner 24. Thus, current from the main contacts 30 and 31 commutates into the circuit including contact 25, arc runner 24 and coil 23 as the initial step of interrupting the circuit between terminals 20 and 21.

Thereafter the arcing contact 25 moves away from the arc runner 24 and an arc is drawn between the upper exposed surface of arc runner 24 and the movable contact 25. Since the coil 23 is very closely magnetically coupled to the ring 24, which acts as a short-circuited turn, an extremely high current is caused to circulate in the shorted turn or arc runner 24. The resultant of the flux produced by the circulating current in arc runner 24 and the flux produced by coil 23 is the flux density $\overline{B}$ which acts on the arc current $\overline{I}$ shown in FIG. 1 thereby producing a force $\overline{F}$ on the arc current which tends to cause it to rotate rapidly around the arc runner 24.

Figure 2:
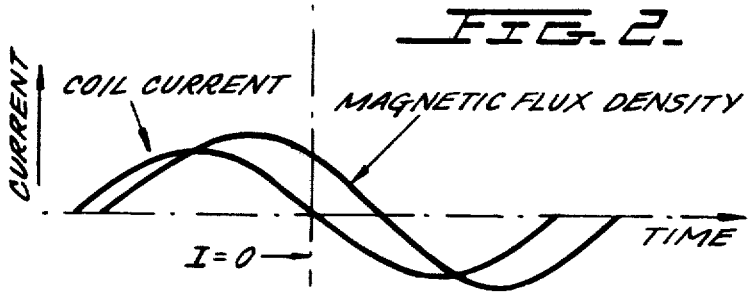
FIG. 2 shows the coil current and magnetic flux density in the arcing gap in the arrangement of FIG. 1 as a function of time.

FIG. 2 shows the coil current I and also shows the magnetic flux density B which is produced by the system of FIG. 1. When the coil current I is zero, the magnetic flux density B is relatively high for a short time prior to current zero and for a short time after the current zero. Thus there is a very substantial force which causes the arc current to continue to rotate, thus enabling the extinction of the arc at the current zero due to the relatively high speed of the arc relative to the stationary gas which fills the gap between the movable contact 25 and the arc runner 24. This gas can, for example, be sulfur hexafluoride at any desired pressure such as, for example, three atmospheres.

The above described operation is old and well known for arc current interrupters. It has been found, however, that arc current interrupters of this type which use non-magnetic materials throughout cannot meet the TRV recovery rate required by ANSI standards at low currents while using a small enough number of turns for the coil which does not create mechanical problems due to the repelling force between the coil 23 and the arc runner 24.

TRV frequency is defined in ANSI standards C37.072-1917 and C37.0722-1971. This specification calls for a 1-cosine type TRV for 72.5kV systems and below. At rated short circuit current the TRV frequency f is defined as $f=\frac{1}{2}T_2$. For values of short-circuit current less than rated short-circuit current, the value of $T_2$ is modified by a multiplier less than one. For example, at 30% rated short-circuit current and 72.5kV system voltage, the $T_2$ multiplier is 0.4. The TRV frequency is therefore 2.5 times higher than at 100% rated current.

Figure 3:
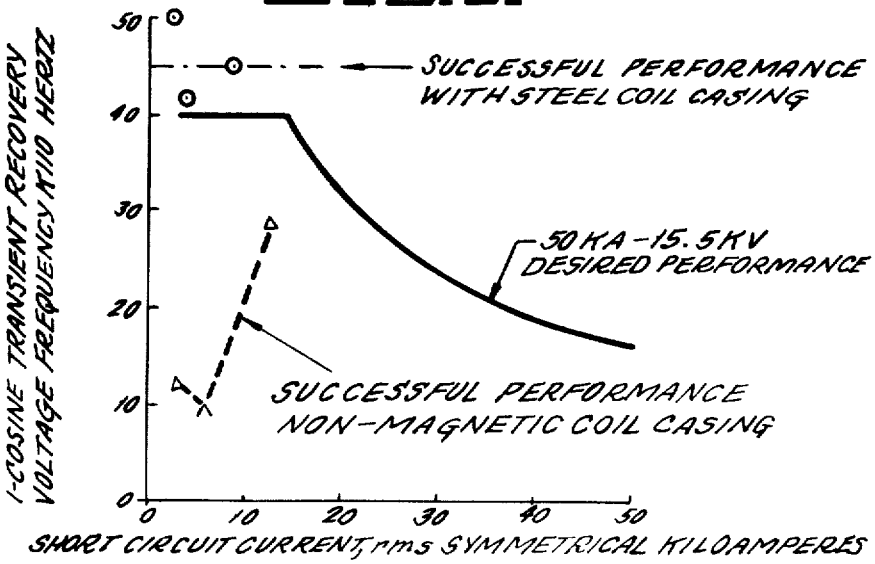
FIG. 3 shows the TRV frequency requirements set forth by ANSI standards and also shows results of tests of arc spinner interrupters using prior art coils composed of non-magnetic materials and coils made in accordance with the invention.

The relationship of TRV frequency versus short-circuit current is shown in the heavy line in FIG. 3 and shows the decrease in required transient recovery voltage frequency as short-circuit current increases toward the rated short-circuit current interrupting ability of the interrupter. This shape curve is required because voltage will rise at a higher rate after extinction of low current arcs and stresses the dielectric capability of the gas more quickly at low current interruption than at high current interruption.

In tests of a coil such as that of FIG. 1, using non-magnetic materials for the coil, it has been found that the TRV capability at currents from 3,000 to 5,000 amperes RMS is between 10 to 20 kilohertz while at 13,000 amperes RMS the TRV capability is between 30 to 40 kilohertz. These test results are shown by triangles connected by dashed lines in FIG. 3 where an open triangle illustrates successful interruption. It will be noted from these test results that the capability of the interrupter was always below the value dictated by standards and shown by the solid line, but the increasing trend is opposite to that required by the decreasing TRV trend shown in the solid line.

By contrast, test results indicated by a circle in FIG. 3 show the successful operation of a coil made in accordance with the invention, and which satisfies the ANSI standards at low current. The same coil which failed to satisfy standards at low current in FIG. 3 was able to successfully interrupt current and satisfy the ANSI standards at higher currents since the magnetic flux density produced in the arcing gap is linearly related to the interrupting current magnitude, and, at high current, a substantial magnetic flux density was provided so that the arc was rotated with sufficient force to cause interruption.

The following demonstrates that the interrupting effort at low currents is much greater than at higher short-circuit currents which conforms to the observed behavior shown in FIG. 3. In the region near current zero and as shown in FIG. 2, the flux density $B_o$ in the $\pm 50$ microseconds surrounding $T_0$ is approximately constant. This flux density $B_o$ can be described as a function of the RMS value of the current being interrupted, I, as:

$$B_o = K \times I$$

where K is some constant of a given coil structure. For example, the constant K includes the mutual inductance between the coil 23 and the arc runner 24 in FIG. 1. K is independent of coil current when the magnetic flux path is of non-magnetic material.

The force on the arc is described by a vector $\bar{F}$ as the vector cross-product:

$$\bar{F} = \bar{I} \times \bar{B}$$

where, $\bar{I}$ is the arc current vector, and, $\bar{B}$ is the magnetic flux density vector.

The above vector quantities are shown in FIG. 1.

Thus, the force to drive the arc near current zero and produce an interruption increases in a linear fashion as the short-circuit current increases for a coil with non-magnetic materials.

Interrupting performance is related to the cooling effect of moving the arc through the $SF_6$ gas. The motion of the arc is provided by the force described above. Near current zero the force will be approximately proportional to current since flux density is nearly constant for this short time period. Thus:

$$F(t)_{(near\ i=0)} = i(t) \times B_0 = i(t) \times K \times I$$

where i(t) is the instantaneous current.

Thus, the force moving the arc near current zero is increased with the current being interrupted. For example, for i(t)=10 amperes, which occurs just prior to I=0 in a high current arc, the force to move that 10 ampere arc when the current being interrupted is 15kA, is three times the force on the 10 ampere arc when the current being interrupted is only 5kA. Therefore, the interrupting effort near current zero is greater at higher short-circuit currents which conforms to the observed behavior shown in FIG. 2.

It is possible, of course, to improve the low current behavior of the interrupter simply by adding turns to the coil 23. This would increase the magnetic flux density B in the interrupting gap at low current. However, the increase in the number of turns of coil 23 will radically increase the repulsion forces between coil 23 and the runner 24. Thus, the repelling forces between coil 23 and arc runner 24 can be shown to be proportional to the number of turns of coil 23 squared times the coil current squared. Thus, increasing the number of turns to meet low current TRV frequency goals results in substantially increasing the repulsion forces at high currents by the square of the turns increased. Thus, the mechanical strength limit of the coil can be easily exceeded with a modest increase in the number of turns of the coil 23.

Another problem existing with the increase of the number of turns is that the coil diameter is also increased. More particularly, with the arrangement of the type shown in FIG. 1, each turn should be as close as possible to the arcing gap to be effective in applying force to the arc. Thus, additional layers or turns of copper strap will increase coil diameter and thereby increase the cost of the interrupter.

The principle of the present invention is to encase substantially the full coil 23 in a high permeability material which is saturable at relatively high coil currents. This configuration will then substantially increase the magnetic flux density in the arcing gap at low currents without requiring an increase in the number of coil turns. Moreover, the novel arrangement of the invention provides a high strength material which can be used for structural reinforcement of the coil and further relieves the designer from highly constrained coil designs in which the coil turns are close to the arc runner and various coil geometries and coil conductor cross-section best suited to a particular application can be used.

Figure 5:
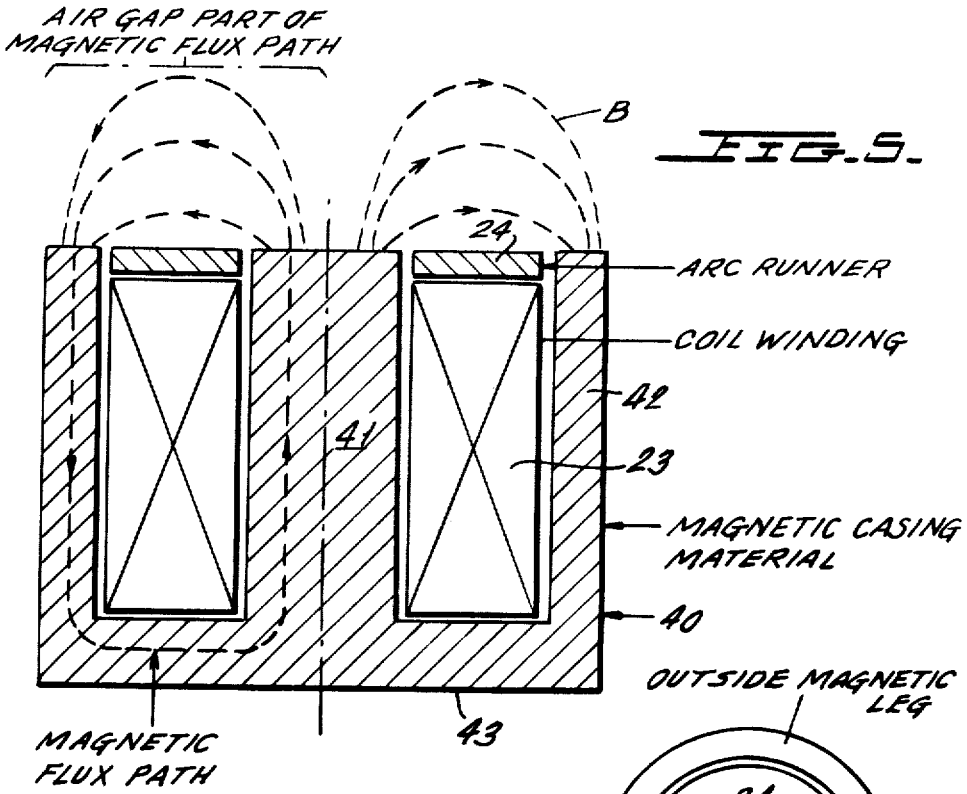
FIG. 5 is a cross-sectional view of FIG. 4 taken across the section line 5—5 in FIG. 4.
Figure 6:
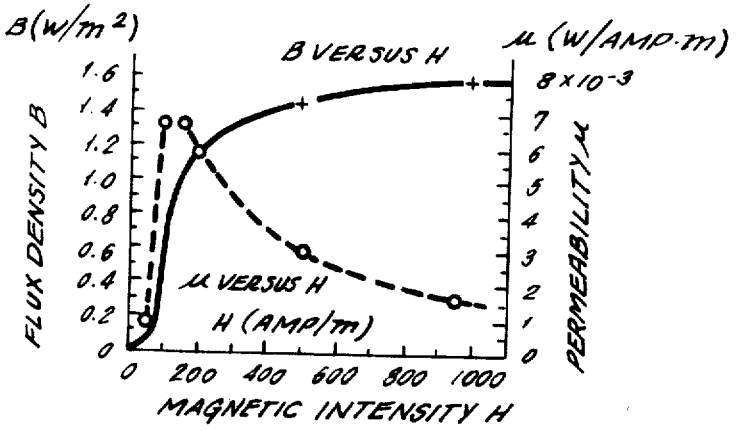
FIG. 6 illustrates the magnetic characteristics of a typical material enclosing the coil in FIGS. 4 and 5.

FIGS. 5 and 6 illustrate the basic concept of the invention, wherein the coil winding 23 which is shown in generalized form in FIG. 5 is coupled to the arc runner 24 and is suitably mechanically secured thereto. The assembly is then encased substantially by a magnetic casing material 40 which consists of a central leg 41 which extends into the internal diameter of coil 23, an external leg 42 and a bottom connection yoke 43. The magnetic casing 40 can be manufactured in any desired way and can, for example, be made of coils of transformer steel for forming members 41 and 42 with the steel oriented to conduct flux in the preferred direction. The bottom yoke 43 interconnects the two members 41 and 42 in any desired way.

One typical material which can be used to form the magnetic casing is cold rolled steel, an inexpensive magnetic material.

Figure 7:
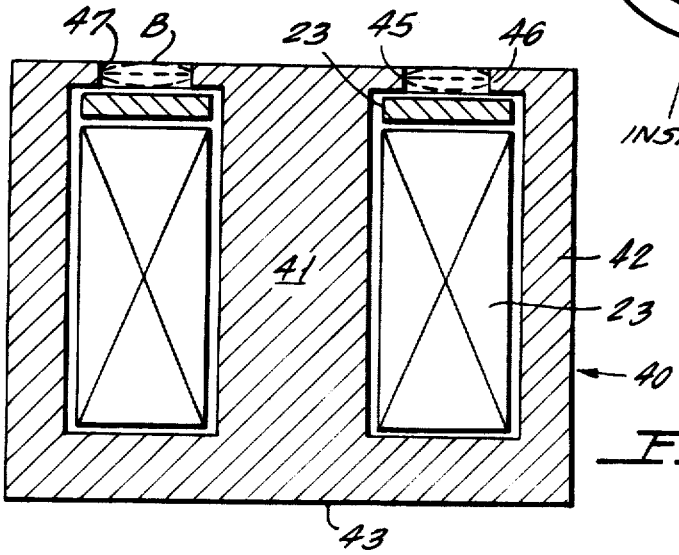
FIG. 7 shows a further embodiment of the invention wherein the magnetic material enclosing the coil is arranged to more directly focus the magnetic flux directly across the top of the arc runner.

In FIG. 5 the central body 41 and outer body 42 of the magnetic casing terminate flush with the upper exposed surface of arc runner 24 and the flux lines extend above the arc runner 24 and fringe as shown in dotted lines. A more focused magnetic field can be produced immediately above the arcing runner 24 by causing the ends of the magnetic casing adjacent the inner and outer diameters of arc runner 24 to bend across the arc runner surface as shown in FIG. 7. Thus, in FIG. 7 the central leg 41 has a projecting outer flange 45 which slightly overlaps the inner diametrical surface of the arc runner 23 while the outer member 42 has an inwardly projecting flange 46 which similarly overlaps the outer diametrical regions of arc runner 42. An annular air gap 47 is then defined which produces the flux density B in the gap immediately above the exposed surface of the arc runner 23.

Figure 4:
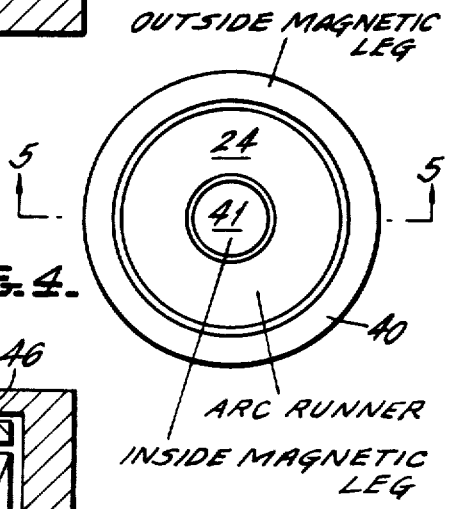
FIG. 4 is a top view of a schematically illustrated coil construction made in accordance with the present invention in which a magnetic material casing encloses the major portion of the coil interrupter.

FIG. 6 shows the magnetization curve and permeability curve of a typical magnetic material that could be used for the magnetic casing 40 in FIGS. 4, 5 and 7. As can be seen from FIG. 6, the magnetic material exhibits a typical magnetic field versus magnetic intensity curve which produces a rapidly increasing flux density at low magnetic intensities. Consequently the permeability versus magnetic intensity curve is sharply peaked for low magnetic intensities and decreases toward the permeability of air at high magnetic intensities indicating saturation of the material. Consequently, when the coil 23 of FIGS. 4, 5 and 7 is substantially encased by magnetic material having the characteristics shown in FIG. 6, the flux density B per ampere of coil current is substantially larger for low currents than for high currents thereby to substantially improve the operation of the coil at low current duty so that the characteristics of FIG. 3 can be attained. Moreover, the amount of magnetic material needed is limited by permitting the material to saturate at higher currents, or higher magnetic intensities, since sufficient flux density is produced at higher intensities to obtain satisfactory interruption operation.

It should be further noted that, if the coil 23 retains the same number of turns, the addition of the magnetic material or transformer steel or the like will permit a much higher total flux in the arcing gap without any other change of the structure. Thus, the total reluctance of the air path is very substantially reduced since up to about 80% of the path will consist of a high permeability leg at low currents.

Moreover, the length of the magnetic path will have a relatively small effect on the total reluctance of the circuit since the majority of the magnetic circuit reluctance will appear in the air gap across the arc runner surface. The coil configuration selected can now take various forms and shapes which best serve a particular application. Thus, different cross-sections can be used as is most convenient to the designer and the coil shape can be made axially long, if desired, for a particular application or purpose.

An important consequence of the novel structure of the invention is that low current interrupting performance is improved without increasing the force of repulsion between the coil 23 and the arc runner 24 at high currents. That is, in the arrangement of the invention, the magnetic material is designed to saturate at the higher currents where good interrupting performance would be obtained in a system which does not use a high permeability magnetic material.

For example, the coil can be designed to have the magnetic material saturate at from 10 to 20 kiloamperes RMS in the arrangement of the type shown in FIG. 3. Thus, at high currents, the flux density produced and the repelling forces which are produced in the assembly will be similar to those which are obtained in the absence of the magnetic material core. Furthermore, the steel casing or core can be used to more securely hold the arc runner in place. Consequently, even though magnetic material is used to improve the interrupting capability of the interrupter at low currents, the repulsion forces which are created within the structure are not increased and the structure is easily reinforced.

As pointed out previously, an important feature of the invention is that each turn of the coil winding no longer has to be as close as possible to the arc gap and arc runner since the magnetic casing is used to carry the magnetic flux density directly to the point of application. The magnetic reluctance of the steel flux path is only a small portion of the total reluctance so that the steel or magnetic path can be lengthened without appreciably affecting flux production. Consequently, coil turns can be increased by increasing the length of the coil rather than its diameter.

This permits a copper ribbon design to be used with more turns added having increased ribbon width and decreased thickness. Thus, the conductor cross-section can be kept constant to meet the current carrying requirement and the total diameter of coil is kept relatively small even though more turns have been added.

As previously described in connection with FIG. 7, the use of the steel core permits shaping and concentration of the flux in the arc gap. Note that the steel path need not bend over both the internal diameter and outer diameter of the arc runner 23 but it would be at least partly effective to have the magnetic path bend around either one of the inner or outer diameters.

Figure 8:
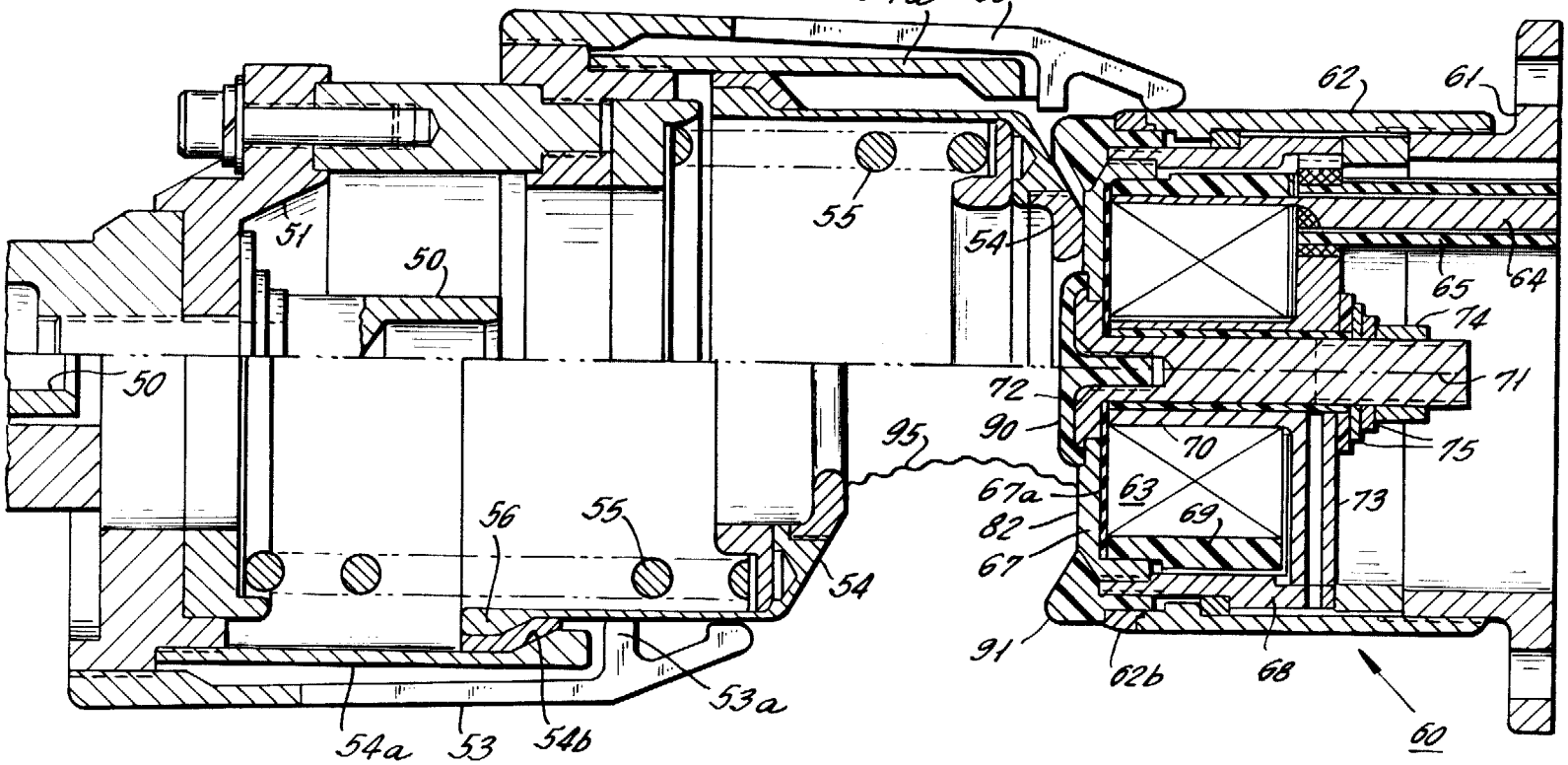
FIG. 8 is a cross-sectional view of a movable contact assembly and a cooperating stationary contact assembly of the type using a saturable magnetic core for the coil of the stationary assembly.

FIG. 8 illustrates the manner in which a stationary contact and coil assembly constructed in accordance with the present invention can cooperate with a movable contact structure which is of the general type shown in the above noted copending application Ser. No. 868,622. In FIG. 8, the parts are shown closed on one side of the center line, and open on the other side of the center line.

Referring to FIG. 8, the movable contact assembly is schematically illustrated as including a movable contact shaft 50 which has a conductive disk 51 extending therefrom and electrically connected thereto. Disk 51 carries a movable contact assembly which includes a plurality of flexible contact fingers 53 which form a tubular cluster of contact fingers. These fingers can be segments of a slotted cylinder and have interior projections 53*a* which slidably engage the conductive cylindrical extension of arcing contact 54. Hollow dished movable arcing contact 54 is slidably contained within sleeve 54*a* which is mounted inside the fingers 53. Contact 54 is pressed outwardly by the compression spring 55 toward an outermost position defined by the location at which the shoulder 56 engages a cooperating interior shoulder 54*b* of member 54*a*.

The stationary contact assembly 60, which is constructed in accordance with the present invention, is carried from an aluminum support flange 61. An elongated copper chromium contact cylinder or ring 62 is threadedly engaged to the aluminum flange 61 and the outer surface of the ring 62 slidably receives the ends of main movable contact fingers 53 of the movable contact assembly. Thus the contacts 53 and 62 serve the function of the main contacts 30 and 31, respectively, shown in FIG. 1. Ring 62 can be terminated by an arcing ring 62*b*.

The main coil corresponding to coil 23 in the preceding figures is shown as coil 63 which may be a spirally wound coil of thin, wide copper. By way of example, coil 63 may have 11 turns of copper sheet having a thickness of about 1/16 inch, with an inner diameter of 0.688 inch, an outer diameter of 1.438 inches and an axial length of about 2.0 inches. The coil convolutions may be insulated by a thin layer of insulation material such as a five mil thick aramid paper.

One terminal of coil 63, shown as terminal 64, is surrounded by insulation tube 65 to ensure its insulation from the aluminum flange 61 and is electrically connected to the outermost convolution of coil 63.

A chromium copper ring 67 which defines the arc runner and corresponds to the ring 24 in FIG. 1 is then seated directly on coil 63 and is insulated therefrom by a suitable insulation spacer 67*a*. The ring 67 is preferably coupled as close as possible to the coil 63. The innermost convolution of coil 63 is electrically connected to a cold rolled magnetic steel ring 70 which is in turn connected to outer conductive ring 68 and the arc runner 67 to complete the desired electric path from terminal 64 to the arc runner 67 which includes the coil 63 in series with the path. Note that the arrangement of FIG. 8 is an outside fed coil, as in application Ser. No. 868,622.

The exterior diameter of coil 63 is received within a ring 69 of insulation material such as G10 to structurally reinforce the outer diameter of the coil 63. Cold rolled steel ring 70 also confines the interior diameter of coil 63 to a particular shape.

In accordance with the invention, a central magnetic steel bolt 71 extends through the interior diameter of the cold rolled steel ring 70. Bolt 71 has a flanged head 72 which overlaps the interior diameter of the arc runner 67 in order to define a concentrated flux path just across the top of the arcing ring 67. Steel ring 70 has a flange 73 which extends across the end of coil 63 in FIG. 8. Flange 73 has a suitable notch through which the lead 64 may pass. A nut 74 threaded onto a threaded extension of the member 71 then securely fixes member 71 in place through the washers 75. Note that members 71, 73 and the flange 72 generally correspond to the central member 41, the yoke 43 and the flange 45, respectively, in FIG. 7.

Ring 68 which is preferably of magnetic steel may have an inwardly turned flange, if desired, corresponding to flange 47 in FIG. 7 to assist in focusing and concentrating the magnetic field across the exposed surface 82 of the arc runner 67.

A Teflon bolt 90 and a Teflon ring 91 may then be fastened relative to the arc runner 67 as shown to protect the underlying portions of the stationary current path structure from the deleterious effects of the arc which will extend from the surface 82 of the arc runner 67.

The total assembly shown in FIG. 8 may then be placed into an interrupter structure which may be of the type shown in any of the above-mentioned copending applications.

In operation, when the contacts are closed, the contact fingers 53 will be in the position shown to the left of the axis in FIG. 8 and the movable arcing contact 54 will press against and be in electrical contact with the bare surface 82 of the arc runner 67. In order to open the interrupter, the operating mechanism moves shaft 50 and the movable contact assembly down. The movable arcing contact 54 remains in engagement with the arc runner 67 until after the main contacts 53 and 62 have separated. After the separation of the main contacts, a current path is established from lead 64 through coil 63 to arc runner 67 and then into the movable arcing contact 54.

Once the movable contact assembly is moved sufficiently down in FIG. 8 and the main shoulder 56 is engaged by shoulder 54*b* of member 54*a*, the arcing contact 54 moves down and an arc 95 is drawn from the movable arcing contact to the arc runner 67. The arc 95 on the arc runner 67 is exposed to the high magnetic flux density which is focused by the magnetic structure which encases the coil 63. This magnetic structure includes members 70, 73, 71 and the flux focusing flange 72. Thus at low interrupting currents, a high flux density is provided to cause extremely rapid rotation of the arc 95 through the sulfur hexafluoride gas which fills the arc gap in order to extinguish the arc at the first current zero. As current increases, the magnetic material in the aforementioned path saturates so that, at higher instantaneous coil currents, the magnetic material in the magnetic path has no effect on the production of flux in the arcing area since the magnetic materials will saturate.

Figure 9:
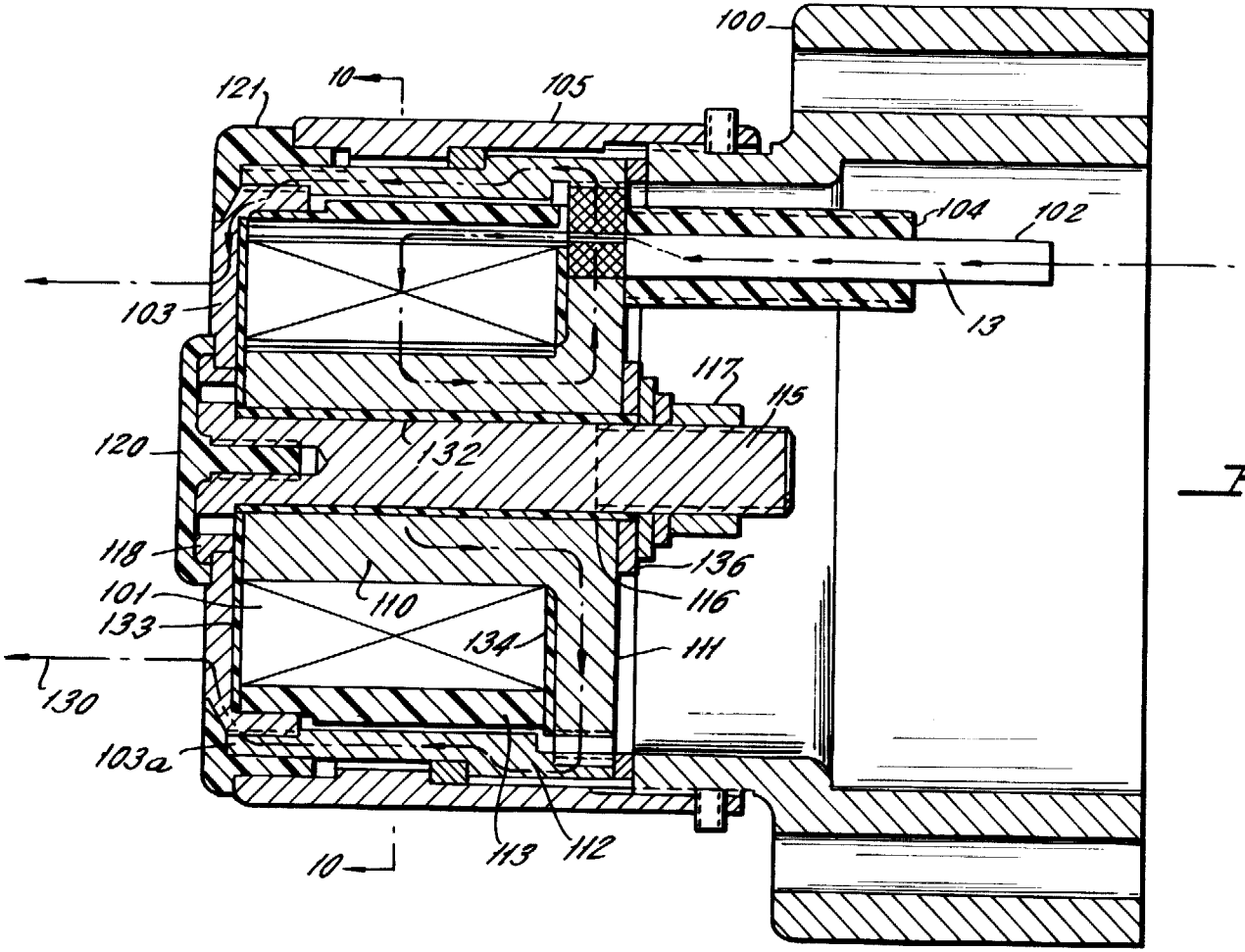
FIG. 9 is a cross-sectional view of a further embodiment of a stationary contact and coil assembly which incorporates the principles of the present invention and which could be used in the assembly of FIG. 8.

FIGS. 9, 10 and 11 show a second embodiment of the stationary contact assembly of the invention. Referring to FIG. 9, the assembly includes the conductive mounting flange 100, and a multi-turn coil 101 which can be made of a spiral wound coil of thin coppper sheet. Coil 101 has an outer terminal 102. Its other terminal 102*a* (FIG. 10) is connected to the steel center hub 110 as by brazing. Preferably, the outer surface of hub 110 is undercut to receive the end 102*a* of the coil 101. The coil is then wound on the hub 101 with an insulation sheet (not shown) insulating the adjacent convolutions from one another. A ring 113 of insulation material encases the outside of coil 101. Ring 113 may be a filamentary wound insulation material of high strength with an outer diameter slightly less than the inner diameter of outer steel casing 112 which receives the coil 101. Insulation ring 113 can be replaced by an epoxy ring which insulates and fixes coil 101 to casing 112. Casing 112 can then be used as a mechanical reinforcement for the coil 101. The lead 102 to coil 101 is insulated by a suitable insulation tube 104.

An outer main contact sleeve 105 is provided to make contact with the main movable contact of the movable contact assembly such as that shown in FIG. 8. Sleeve 105 may be appropriately threadably secured to the flange 100. The end of coil 101 opposite to terminal 102 is suitably connected to the arc runner 103 via the steel center hub 110, the yoke 111 and the steel casing 112 in order to form the desired electrical connection from terminal 102 to arc runner 103. Central leg 110, yoke 111 and second outer steel ring 112 also completes the desired magnetic path.

Arcing contact ring 103 has an exterior cylindrical extension 103*a* which is externally threaded and threadably secures the arcing contact ring 103 to the steel outer member 112, thereby securely fastening the ring 103 relative to the coil 101 which is also securely fixed within the steel encasing structure.

A central magnetic steel bolt 115 then extends through the center of magnetic member 110 and is insulated therefrom by the insulation tube 116 and is fixed in place by a nut 117. Bolt 115 has a flanged end 118 which overlies the inner diameter of the ring 103, thereby to at least partially focus and concentrate magnetic flux over the surface of the ring 103. The Teflon insert 120 (FIG. 9) is fixed over the interior surface of the contact assembly and a Teflon ring 121 is fixed over the exterior surface of the left-hand region of the contact assembly.

The current path shown by arrows 130 is formed to define an outside fed coil. Moreover, this current path includes those parts used to form the novel magnetic circuit of the invention. This current path is defined by providing insulation cylinders 113 and 132, and insulation disks 133, 134 and 135 to force the desired current path.

Figure 12:
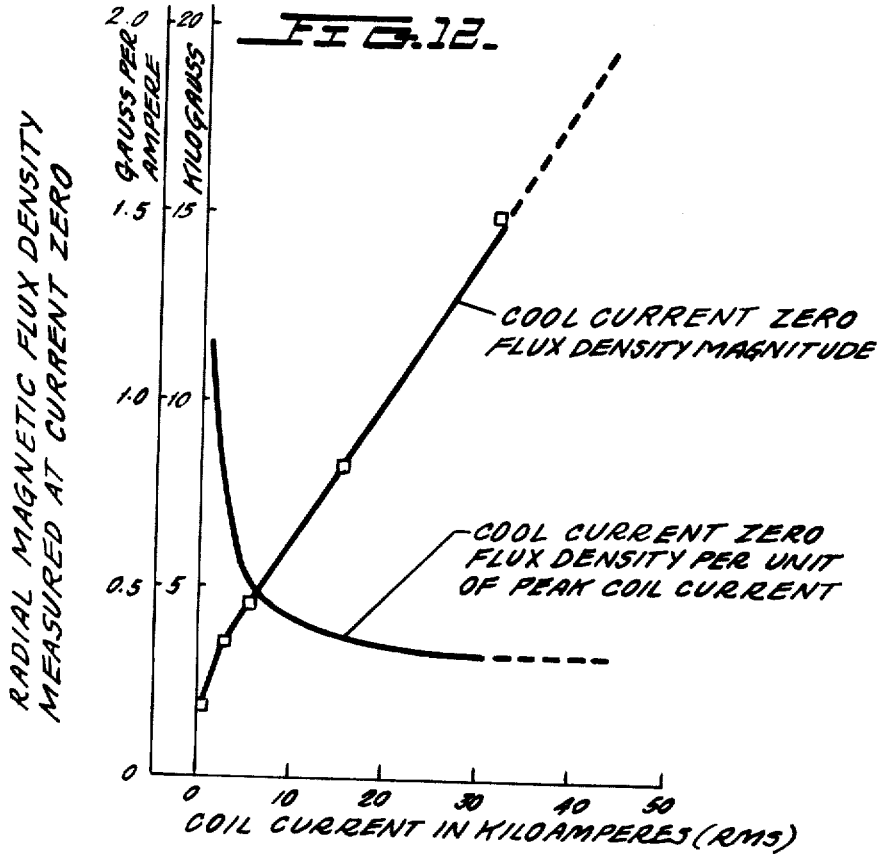
FIG. 12 contains tests results which were obtained with a structure similar to that of FIG. 9 and illustrates the flux density measurements made above the arc runner in FIG. 9.

The assembly of FIG. 9 was tested in an assembly of the type generally shown in FIG. 8 and flux density measurements were made at the arc runner surface 130 at the instant coil current zero for the coil 101. The flux density magnitude varied as shown in the labelled curve in FIG. 12.

However, as shown in the curve labelled flux density per unit of peak coil current, it is seen that the flux density per unit of current decreased in the manner expected over the coil current range of from about 0 to about 30 kilo-amperes. Consequently, the objective sought of substantially increasing the magnetic field density under conditions of low arc current was accomplished by the assembly of FIG. 9 which uses a saturable magnetic casing around the coil in accordance with the present invention.

The invention permits flexibility of choice of coil conductor cross-section. For example, the conductor can be made long and thin in cross-section. In some applications, the conductor can even be square in cross-section and formed in a multi-turn configuration.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An arc spinner interrupter comprising, in combination: a movable contact; an arc runner disk formed of a flat disk of conductive material engageable by said movable contact, and having one surface area for receiving the arc root of an arc drawn between said movable contact and said arc runner disk; a coil connected in series with said arc runner disk; said coil having the shape of a toroid having a rectangular cross-section; said coil having an inner diameter, an outer diameter and first and second parallel end surfaces; said arc runner disk being fixed adjacent to said first end surface of said coil; a substantially static arc extinguishing fluid disposed in the region between said movable contact and said arc runner disk; and a casing of magnetic material which is U-shaped in cross-section and which is fitted around said inner diameter, said second surface and said outer diameter of said coil; the ends of the legs of said U-shaped casing being adjacent to the inner and outer diameters respectively of said arc runner disk; said casing being of a magnetic material having a magnetic permeability greater than that of air and defining a relatively low reluctance magnetic path for magnetic flux around said coil and to the region between said one surface area of said arc runner disk and said movable contact; said interrupter having a rated interrupting current; at least portions of said casing of magnetic material being saturated by the field due to said coil when the current in said coil is less than said rated interrupting current but greater than some relatively low given value, and wherein said casing of magnetic material is unsaturated at coil currents lower than said relatively low given value in order to improve the ability of said interrupter to interrupt low current faults by having an increased flux density per ampere in the arcing region during relatively low current interruption.

2. The interruper of claim 1, wherein said coil consists of a conductor having a generally square cross-section wound in a plurality of axial layers each having a plurality of turns, whereby some turns of said coil are spaced by a greater distance from said arc runner disk than are others.

3. The interrupter of claim 1, wherein said coil is spirally wound of a thin, wide conductor strip which is coaxial with said arc runner disk.

4. The interrupter of claim 1 which includes connection means for connecting one end of said coil to said arc runner; said connection means at least partly including said magnetic material.

5. A stationary contact assembly for an arc current interrupter; said assembly comprising:

a flat arc runner disk having first and second opposite surfaces; said first surface being operable to receive the arc root of a rotating arc;

a coil having a plurality of turns fixed coaxially with said disk and having one end surface which is adjacent to said second surface of said disk;

and a magnetic circuit consisting of ferromagnetic material which encloses the periphery of said coil and contains an annular air gap immediately adjacent to said first surface of said arc runner disk; said coil being rated to interrupt a given short-circuit current; said ferromagnetic material having a sufficiently small cross-sectional area that said material saturates at a coil current less than said given current.

6. The assembly of claim 5 wherein said coil consists of a conductor having a generally square cross-section wound in a plurality of axial layers each having a plurality of turns, whereby some turns of said coil are spaced by a greater distance from said arc runner disk than are others.

7. The assembly of claim 5 wherein said coil is spirally wound of a thin, wide conductor strip which is coaxial with said arc runner disk.

8. The assembly of claim 5 wherein said coil is electrically connected to said disk by said magnetic circuit.

* * * * *